US005248137A

United States Patent [19]

Rabjohns

[11] Patent Number: 5,248,137

[45] Date of Patent: Sep. 28, 1993

[54] HIGH CAPACITY FEEDER INITIALIZATION

[75] Inventor: Douglas T. Rabjohns, Fairport, N.Y.

[73] Assignee: Xerox Corporation, Stamford, Conn.

[21] Appl. No.: 933,162

[22] Filed: Aug. 21, 1992

[51] Int. Cl.[5] ..... B65H 1/16

[52] U.S. Cl. ..... 271/155; 271/24; 271/30.1; 271/157

[58] Field of Search ..... 271/22, 24, 30.1, 126, 271/128, 152, 154, 155, 157

[56] References Cited

U.S. PATENT DOCUMENTS

| | | | |
|---|---|---|---|
| 3,768,806 | 10/1973 | Reehil | 271/155 |
| 4,801,135 | 1/1989 | Povio | 271/157 X |
| 4,832,329 | 5/1989 | Rodi et al. | 271/155 |
| 4,852,869 | 8/1989 | Watanabe et al. | 271/155 X |
| 4,919,410 | 4/1990 | Robinson, Jr. et al. | 271/155 X |

FOREIGN PATENT DOCUMENTS

| | | | |
|---|---|---|---|
| 0027850 | 2/1986 | Japan | 271/155 |

*Primary Examiner*—H. Grant Skaggs
*Assistant Examiner*—Carol Lynn Druzbick
*Attorney, Agent, or Firm*—Ronald F. Chapuran

[57] ABSTRACT

An apparatus in which a stack of sheets is detected at a preselected location. An air jet is directed towards an edge of the stack of sheets at a preselected location. A pressure transducer is located at the prescribed location and positioned to have the air jet at impact thereon. The pressure transducer is enabled to transmit a signal indicative of the absence of the stack of sheets at the preselected location in response to the air jet impacting thereon. The pressure transducer is inhibited from transmitting the signal in response to the stack of sheets blocking the air jet. When the stack of sheets blocks the air jet, the signal from the pressure transducer indicates the presence of the stack of sheets at the preselected location. A pneumatic stack height detector of this type may be used to regulate the movement of a stack of sheets used in electrophotographic printing machines.

8 Claims, 2 Drawing Sheets

HIGH CAPACITY FEEDER INITIALIZATION

Figure 1:
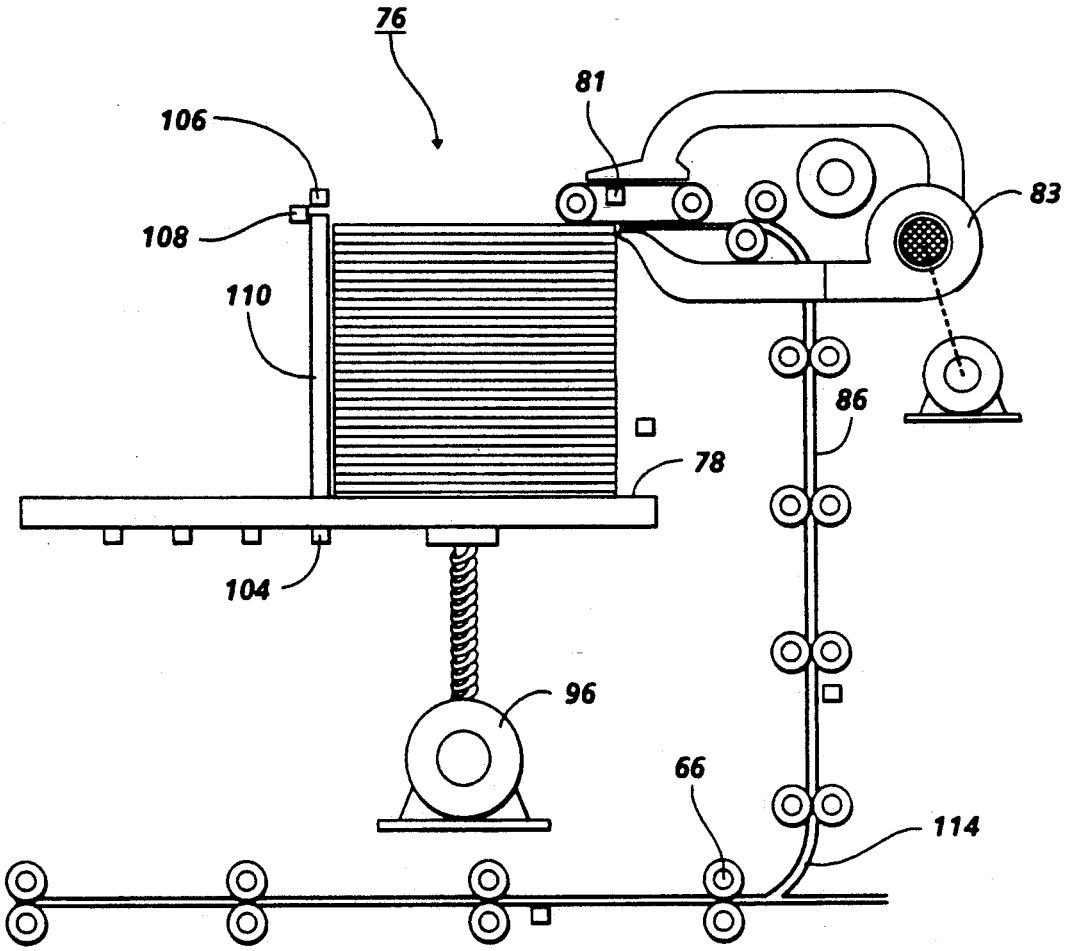

This invention relates generally to an electrophotographic printing machine, and more particularly, to the rapid registration of a high capacity copy sheet feeder for the machine.

In typical electronic imaging processes, a photoconductive member is charged to a substantially uniform potential and exposed to a light image of an original document being reproduced to selectively dissipate the charge. After the electrostatic latent image is recorded on the photoconductive surface, the latent image is developed by the application of developer material including toner particles forming a toner powder image on the photoconductive surface. The toner powder image is then transferred from the photoconductive surface to a copy sheet and heated to permanently affix the powder image to the copy sheet.

In typical high speed commercial imaging machines, large volumes of copy sheets are fed from copy sheet feed trays in registration with the toner powder image on the photoconductive member. Typical large volume copy sheet feed trays are an elevator type mounted on a frame for movement vertically from a sheet feeding position to a sheet loading and unloading position. At the lowermost position, copy sheets are loaded or unloaded from the tray. After the copy sheets are loaded in the tray, the tray ascends to its uppermost or top position for sheet feeding. A sensor is located at the top region to indicate when the stack of sheets is positioned appropriately for sheet feeding. As successive sheets are advanced from the stack on the elevator, the sensor will eventually fail to detect the presence of a sheet suitably positioned for correct sheet feeding. The sensor will then provide an appropriate signal. Upon detection of this signal, the elevator is indexed in an upward direction to position the next successive sheet adjacent the sheet feeder. In one embodiment, approximately 10 copy sheets are fed before the signal fails to detect a copy sheet in the proper sheet feed position. Thus, there is a periodic indexing of the elevator to maintain correct copy sheet alignment with respect to the conveying apparatus for feeding copy sheets to the photoconductive member of image transfer. This is achieved by a control system having an output signal from the stack height sensor transmitted through control logic to a motor which drives the tray bi-directionally. In this way, movement of the elevator having the stack of sheets is controlled as a function of the location of the uppermost sheet of the stack.

Various approaches have been devised for detecting the location of the stack of sheets loaded on an elevator and being positioned adjacent a sheet feeder for advancement to the processing stations within the printing machine. For example, U.S. Pat. No. 3,768,806 discloses a transducer provided to ascertain when the topmost sheet of a stack of sheets is in the proper position for feeding to the sheet transport mechanism.

A difficulty with the prior art systems are the time delays necessary in large volume copy sheet feed trays mounted on a frame for movement vertically between a sheet feeding position and a sheet loading and unloading position. This reciprocal movement is generally required whenever the tray is not in use, but the stack height must be verified, that anytime the tray is initialized and the stack is not at the feed postion. In addition, between jobs or reproduction requirements, there is the natural tendency of copy sheets to settle within the copy sheet tray. This settling of copy sheets often results in the copy sheet or paper stack dropping below the top of stack sensor. Thus, when the machine is cycled up, a signal is generated that the top of the stack is not in the correct feeder position. Unfortunately, this causes the machine to initiate the time consuming reciprocal movement of the elevator for measuring the quantity of paper that exists in the tray.

It would be desirable to provide a technique for avoiding the time consuming reciprocal movement of the elevator supporting a stack of copy sheets during cycle up or after job interruptions and for compensating for the settling of copy sheets in a high capacity copy sheet tray.

It is an object of the invention, therefore, to provide a new and useful copysheet feeder registration system. It is another object of the present invention to provide a simple cycle up procedure for a high capacity sheet feeder that is efficient and avoids time consuming elevator movement. Other advantages of the present invention will become apparent as the following description proceeds, and the features characterizing the invention will be pointed out with particularity in the claims annexed to and forming a part of this specification.

The present invention includes a sheet feeder and a tray arranged to have the stack of copy sheets disposed thereon. The tray is adapted to move between a first position with an outermost copy sheet of the stack being adjacent the sheet feeder and a second position for loading sheets. The sheet feeder is adapted to advance successive outermost copy sheets from the stack thereof with the tray being in the first position. Means are provided for moving the tray in a cyclic manner between the first and second positions and in an incremental indexing manner. A detector senses the absence and presence of the outermost sheet adjacent the sheet feeder and the moving means, in response to the signal from the detector, indexes the tray to position the outermost copy sheet of the stack adjacent the sheet feeder.

Figure 2:
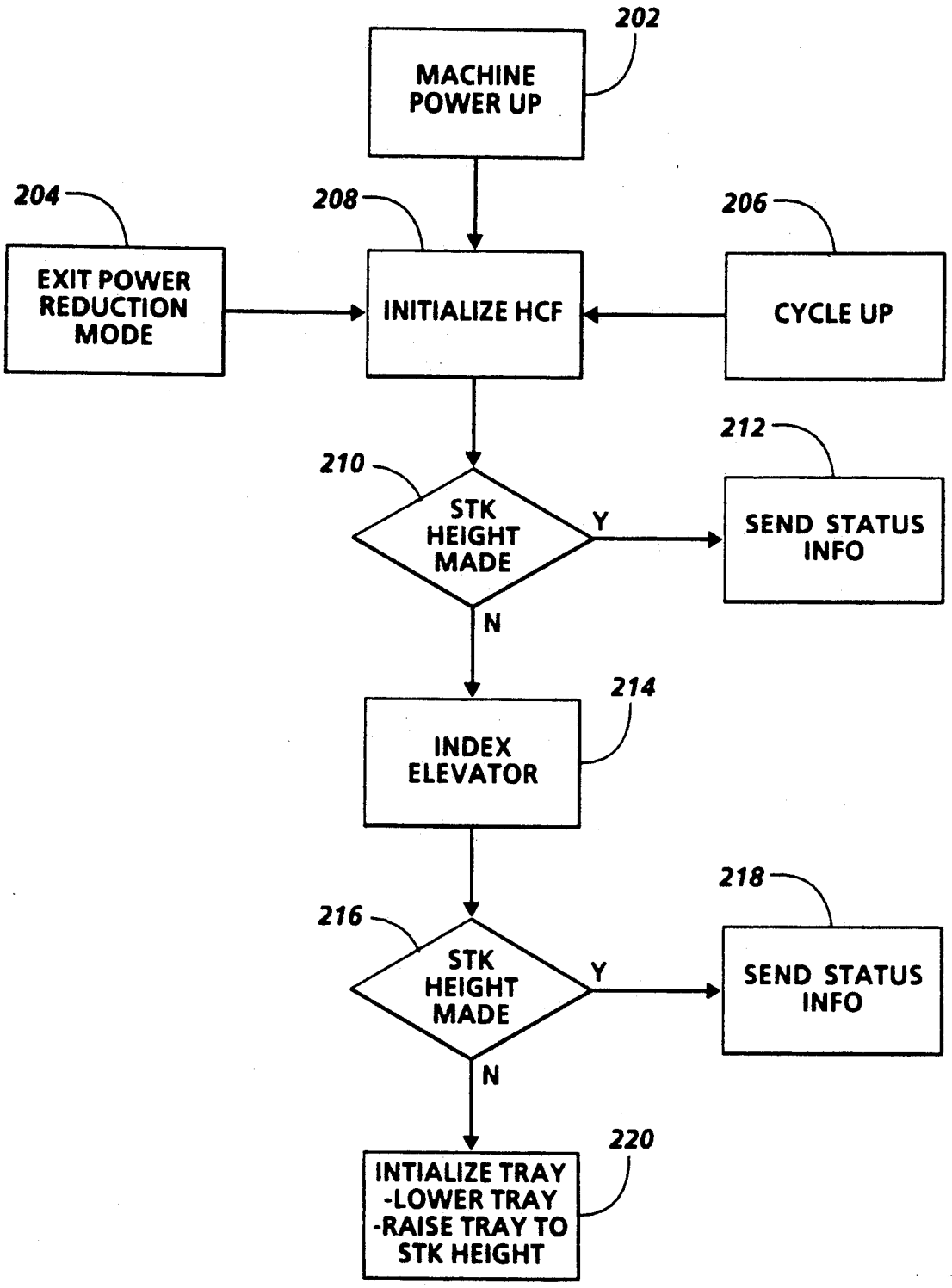

Other aspects of the present invention will become apparent as the following description proceeds and upon reference to the drawings, in which:

FIG. 1 is a schematic elevational view showing the sheet handling apparatus incorporating the present invention, and FIG. 2 is a flow chart illustrating the automatic feeder indexing in accordance with the present invention.

With reference to FIG. 1, a high capacity feeder, indicated generally by the reference numeral 76 is a typical source of copy sheets. High capacity feeder 76 includes a tray 78 supported on a elevator 80. The elevator is driven by a bidirectional AC motor 96 to move the tray up or down. In the up position, the copy sheets are advanced from the tray.

Typically in a xerographic imaging machine, the sheets are advanced to a transfer station. A fluffer 83 directs air onto the stack of copy sheets on tray 78 to separate the uppermost sheet from the stack of copy sheets. A vacuum pulls the uppermost sheet against feed belt 81. Feed belt 81 feeds successive uppermost sheets from the stack to transport 86. Transport 86 advances the sheet to roll 66 which, in turn, moves the sheet to transfer station.

The high capacity feeder 76 has associated therewith a stack height sensor 108. The stack height sensor 108 determines when the stack sheets are positioned closely adjacent to the sheet feeder. Thus, the stack height sensor controls the movement of the tray in a vertical direction relative to the sheet feeder. As successive sheets are advanced from the stack disposed on the respective tray, the stack height sensor detects the absence of sheets adjacent the sheet feeder and regulates a motor for advancing the tray upwardly to position the next successive topmost sheet of the stack adjacent the sheet feeder. In this way, successive topmost sheets are advanced from the respective stack of sheets by the corresponding sheet feeder.

As described, elevator 80 is driven by a bi-directional AC motor 96. Motor 96 drives elevator 80 to move tray 78 up and down. Up limit switch 106 and down limit switch 104 de-energize motor 96 to prevent the elevator from moving the tray to far in the vertical direction. Stack height detector 108 is mounted on movable rear guide 110 and provides an indication of when the uppermost sheet of the stack is in the feeding position. Stack height detector 108 controls motor 96 to maintain the uppermost sheet of the stack in the sheet feeding position adjacent feed belt 81.

Flutter 83 directs air onto the stack of sheets in the sheet feeding position. The flutter blows against the side edge of the stack of sheets. As the top sheet is separated from the remaining sheets in the stack, a vacuum pulls the top sheet against feed belt 81. Transport 86 moves the sheet into baffle 114 which guides the sheet into the nip defined by roller pair 66 to move the sheet to the transfer station.

The high capacity feeder tray 78 is lowered to the operator access level in the event of sheet jams, low paper signals or operator down commands. Tray 78 is positioned so that the topmost sheet of the stack is in the sheet feed position. If a low paper signal is transmitted to the controller, motor 96 is energized to move elevator 80 and tray 78 in a downward direction until sensor 104 (tray down) is actuated. When the elevator is closed, motor 96 is energized to move elevator 80 and tray 78 in an upward direction until sensor 108 indicates that the topmost sheet of the stack is properly positioned adjacent the sheet feeder.

As stated above, approximately ten copy sheets in one embodiment are fed before the detector signal fails to detect a copy sheet in the proper sheet feed position. Upon detection of this signal, there is then indexing of the elevator to move the stack of sheets back up into the proper position for sheet feeding. The indexing is a relatively quick response during machine operation before continuing operation. Also, as discussed above, because of copy sheet settling between jobs or during job interruptions, there is often a "not ready" signal provided at machine start up or cycle up for the next job or after the interruption. In prior art systems, this not ready signal would cause the machine to cycle through an elevator down and up routine to determine the sheet capacity on the elevator and to ready the sheets for feeding. However, it has been discovered that rather than the elaborate cycling of the elevator which is relatively time consuming, usually a mere indexing of the elevator after the job interruptions would be sufficient to move the sheets into the sheet ready position. A simple procedure as illustrated in FIG. 2, eliminates this time consuming and annoying recycling of the elevator procedure and makes the copy sheets stack immediately ready for copy sheet feed.

With reference to FIG. 2, the initialized high capacity feeder operator or indexing of the tray 78 is shown at block 208. This could be any return from a power reduction mode illustrated at 204, cycle up 206 or power up of the machine 202 at start up, after the completion of a previous job, or during any interruption of a current job, in particular, in which there is time for the paper in the sheet stack to settle to the degree to generate a sheet "not ready" to feed signal. Block 210 illustrates the decision to be made whether or not the upper most copy sheet is in a feed position. That is, the top of the stack sensed by stack height sensor 108. If the copy sheet is in a sheet feed ready position, then obviously the machine can immediately continue the job as shown at block 212. At this time various status and operation messages and data are sent to begin operation. If on the other hand, the top most copy sheet is not in a sheet ready position, rather than moving the tray in a cyclic manner between the first and second position, in accordance with the present invention, the copy sheet stack or elevator is quickly indexed as illustrated at block 214. As explained above, this indexing of the elevator is a rapid upward shifting of the elevator to move the top most copy sheet into a sheet ready position as opposed to a relatively time consuming recycling down and up of the elevator.

After the indexing of the elevator as shown in block 214, there is a determination as illustrated at block 216 whether or not the top most copy sheet is now in the copy sheet feed ready position. If not the elevator and the copy sheet stack are initialized as illustrated at block 220. That is the time consuming procedure of lowering and elevating the elevator to determine tray capacity and to bring the top of the stack into the sheet ready position is accomplished. It should be understood that although one indexing operation has been illustrated, it is well within the scope of the present invention to have additional indexing operations if the first index operation fails to bring the top of the stack into the sheet feed ready position. Since the indexing operation is relatively quick, less than one second, it might be much more time efficient to attempt more than one indexing operation to achieve the sheet feed ready position, rather than to immediately go into the time consuming initialization procedure approximately 32 seconds. When the top most copy sheet is in the sheet feed ready position, the machine can then continue operation with the job as illustrated in block 218.

While the present invention has been described in connection with a preferred embodiment thereof, it will be understood that it is not intended to limit the invention to that embodiment. On the contrary, it is intended to cover all alternatives, modifications and equivalents, as may be included within the spirit and scope of the invention as defined by the appended claims.

I claim:

1. In an electronic imaging machine of the type in which a latent image is developed on a photoconductive member and the developed image is transferred to a copy sheet with successive copy sheets being supplied from a stack to the photoconductive member via a transport, a sensor for determining a sheet feeding location of the stack with respect to the transport, a control for positioning the stack in feeding relationship with respect to the transport by either an initialization cycle including the successive steps of first lowering and then raising said stack to said predetermined location or by indexing the stack an incremental distance comprising the steps of:

starting a machine cycle up, responding to the machine cycle up by automatically indexing the stack the incremental distance in the direction of the sensor, sensing a deviation of the sheet feeding location of the stack with respect to the transport, and initiating a stack initialization cycle in response to the deviation of the sheet feeding location of the stack with respect to the transport.

2. The method of claim 1 including the steps of automatically indexing the stack the incremental distance a given number of times.

3. The method of claim 1 wherein the initialization cycle is a relatively long time period in relation to the indexing time period.

4. In an electronic imaging machine of the type in which a latent image is developed on a photoconductive member and the developed image is transferred to a copy sheet with successive copy sheets being supplied from a stack to the photoconductive member via a transport, a sensor for determining a predetermined location of the stack with respect to the transport, the method of positioning the stack in feeding relationship with respect to the transport upon cycle up of the machine including the steps of:

automatically indexing the stack an incremental distance in relation to the sensor in response to a machine cycle up, determining the location of the stack with respect to the transport, and initiating a stack repositioning operation upon determination that the location of the stack with respect to the transport deviates from said predetermined location.

5. The method of claim 4 wherein the step of initiating a stack repositioning operation includes the successive steps of first lowering and then raising said stack to said predetermined location.

6. The method of claim 4 wherein the step of automatically indexing the stack an incremental distance in relation to the sensor occurs after a machine cycle down.

7. An electronic imaging machine of the type in which a latent image is developed on a photoconductive member and the developed image is transferred to a copy sheet with successive copy sheets being supplied from a stack to the photoconductive member via a transport, a sensor for determining a predetermined location of the stack with respect to the transport, a control for positioning the stack in feeding relationship with respect to the transport by either an initialization cycle or by indexing the stack an incremental distance wherein the improvement comprises responding to the machine cycle up by automatically indexing the stack the incremental distance before initiating a stack initialization cycle.

8. The machine of claim 7, wherein the initialization cycle includes the successive steps of first lowering and then raising said stack to said predetermined location.

* * * * *